US005664425A

United States Patent [19]

Hyde

[11] Patent Number: 5,664,425

[45] Date of Patent: Sep. 9, 1997

[54] PROCESS FOR DEHUMIDIFYING AIR IN AN AIR-CONDITIONED ENVIRONMENT WITH CLIMATE CONTROL SYSTEM

[76] Inventor: Robert E. Hyde, 18448 S.E. Pine St., Portland, Oreg. 97233-4859

[21] Appl. No.: 596,046

[22] Filed: Feb. 6, 1996

Related U.S. Application Data

[60] Division of Ser. No. 276,705, Jul. 18, 1994, Pat. No. 5,509,272, which is a continuation-in-part of Ser. No. 136, 112, Oct. 12, 1993, Pat. No. 5,329,782, which is a continuation-in-part of Ser. No. 948,300, Sep. 21, 1992, Pat. No. 5,291,744, which is a division of Ser. No. 666,251, Mar. 8, 1991, Pat. No. 5,150,580.

[51] Int. Cl.[6] ..... F25B 9/00; F25B 41/00

[52] U.S. Cl. ..... 62/90; 62/196.1; 62/DIG. 2

[58] Field of Search ..... 62/176.4, 173, 62/90, 196.1, DIG. 2

[56] References Cited

U.S. PATENT DOCUMENTS

| | | | |
|---|---|---|---|
| 1,946,328 | 2/1934 | Neff . | |
| 2,386,505 | 10/1945 | Puchy | 417/420 |
| 2,632,304 | 3/1953 | White, Jr. | 62/DIG. 2 |
| 2,949,750 | 8/1960 | Kramer | 62/DIG. 2 |
| 2,967,410 | 1/1961 | Schulze . | |
| 3,798,920 | 3/1974 | Morgan | 62/90 X |
| 3,921,413 | 11/1975 | Kohlbeck | 62/173 |
| 4,419,865 | 12/1983 | Szymaszek . | |
| 4,599,873 | 7/1986 | Hyde | 62/DIG. 2 |
| 4,984,433 | 1/1991 | Worthington | 62/90 |
| 5,097,667 | 3/1992 | Holtzapple . | |
| 5,329,782 | 7/1994 | Hyde | 62/DIG. 2 |

FOREIGN PATENT DOCUMENTS 0247963 7/1987 German Dem. Rep. .

*Primary Examiner*—William E. Wayner

*Attorney, Agent, or Firm*—Marger Johnson McCollom & Stolowitz, P.C.

[57] ABSTRACT

A reheater is used in air-conditioning system which includes a compressor, a condenser, an expansion valve, and an evaporator, interconnected by conduits in a closed loop. A first conduit coupling a flow of liquid refrigerant through the expansion valve into the evaporator. A second conduit coupling an outlet of the evaporator to an inlet of the compressor. A third conduit coupling an outlet of the compressor to an inlet of the condenser. A centrifugal pump is coupled to an outlet of the condenser for boosting a pressure of the condensed liquid refrigerant by an incremental pressure sufficient to pressure subcool the refrigerant. A reheater is positioned adjacent to the evaporator and coupled to an outlet of the centrifugal pump, for receiving pressure subcooled liquid refrigerant and cooled air from the evaporator to further subcool the liquid refrigerant to a temperature below its condensing temperature and to effect a partial reheating of the cooled flow of air thereby decreasing the relative humidity of the flow of the air. A reheater bypass conduit coupled between an inlet of the evaporator and the outlet of the pump. A bypass control valve positioned on the reheater bypass conduit for controlling the flow of liquid between the outlet of the pump and the inlet of the evaporator. A solenoid, coupled to the bypass control valve for actuating the valve. A controller, electronically coupled to the solenoid, capable of receiving humidity and temperature data and being programmed to actuate the solenoid in response to the data.

10 Claims, 6 Drawing Sheets

PROCESS FOR DEHUMIDIFYING AIR IN AN AIR-CONDITIONED ENVIRONMENT WITH CLIMATE CONTROL SYSTEM

This is a division of application Ser. No. 08/276,705, filed Jul. 18, 1994, now U.S. Pat. No. 5,509,272 which is a continuation-in-part of U.S. Ser. No. 08/136,112, filed Oct. 12, 1993, now U.S. Pat. No. 5,329,782, issued Jul. 19, 1994, which is a continuation-in-part of U.S. Ser. No. 07/948,300, filed Sep. 21, 1992, now U.S. Pat. No. 5,291,744, issued Mar. 8, 1994, which is a division of U.S. Ser. No. 07/666, 251, filed Mar. 8, 1991, now U.S. Pat. No. 5,150,580, issued Sep. 29, 1992.

BACKGROUND OF THE INVENTION

This invention relates generally to refrigeration and operation and more particularly to a method and apparatus for boosting the cooling capacity and efficiency of air-conditioning systems under a wide range of ambient atmospheric conditions.

In air conditioning, the basic circuit is essentially the same as in refrigeration. It comprises an evaporator, a condenser, an expansion valve, and a compressor. This, however, is where the similarity ends. The evaporator and condenser of an air conditioner will generally have less surface area. The temperature difference $\Delta T$ between condensing temperature and ambient temperature is usually 27° F. with a 105° F. minimum condensing temperature, while in refrigeration the difference $\Delta T$ can be from 8° F. to 15° F. with an 86° F. minimum condensing temperature.

I have previously improved the cooling capacity and efficiency of refrigeration systems. As disclosed in my U.S. Pat. No. 4,599,873, this is accomplished by addition of a liquid pump at the outlet of the receiver or condenser. Operation of the pump adds 5–12 p.s.i. of pressure to the condensed refrigerant flowing into the expansion valve, a process I call liquid pressure amplification. This suppresses flash gas and assures a uniform flow of liquid refrigerant to the expansion valve, substantially increasing cooling capacity and efficiency. The best results are obtained when such a system is operated with the condenser at moderate ambient temperatures, usually under 80° F. As ambient temperatures rise above the minimum condensing temperature, the advantages gradually decrease. The same thing happens when the principles of my prior invention are applied to air conditioning, except that the minimum condensing temperature is higher.

While conventional air-conditioning systems can benefit from my prior invention, the greatest need for air conditioning is when ambient temperatures are high, over 80° F. Conventional air conditioning becomes less effective and efficient as ambient temperatures rise to 100° F. or more, as does use of my prior liquid refrigerant pressure amplification technique.

In conventional air conditioning systems, as liquid refrigerant exits the thermal expansion valve, a certain portion of it will flash or boil off to reach the desired coil temperature. This flashing off of liquid refrigerant does no practical refrigerant work yet the compressor must compress this vapor which increases the power requirement of the system. Thus, it is desirable to decrease system flashing and therefore increase the efficiency of air conditioning systems.

One of the important function of an air conditioning system is dehumidification. Dehumidification has many advantages. Lower humidity reduces the amount of compressor power needed. Lower relative humidity also allows a higher thermostat set point while providing for the same level of human comfort. This translates into an energy savings of about 3% to 5% per °F. In office buildings, apartments, hotels, and homes, lower humidity in delivery ducts reduces mold, bacteria growth, allergic reactions, and building sickness syndrome.

Lower humidity is also very advantageous to grocery stores. For example, excessive humidity greatly increases grocery store refrigeration costs. It reduces heat transfer and thus requires lower coil temperatures, requires more frequent defrosting, and can damage product appearance.

Dehumidification is accomplished by decreasing the relative humidity of the flow of ambient air received by the air conditioning system. Relative humidity can be decreased in two ways: (1) removing moisture from the air; and (2) heating the air to increase its volume while maintaining a constant amount of water contained therein.

In many areas, moisture removal is the most important function of an air conditioning system. In addition, moisture removal generally consumes much of the power required to operate the system. It is the system's evaporator that removes most of the moisture from ambient air in an air-conditioning system. Thus, the system will remove more moisture if the efficiency of the evaporator is increased.

The second method of deliumidification is reheating ambient air to increase its relative humidity. Thus, if both moisture removal and reheating could be accomplished simultaneously in a single system, greater dehumidification would be achieved and the efficiency of the air conditioning system would be greatly enhanced. Moreover, decreased flashing would require less compressor work and thus gives a further increase in efficiency. Accordingly, it is the object of this invention to provide such a system.

SUMMARY OF THE INVENTION

This invention is an air conditioning system for cooling and decreasing relative humidity of a flow of air which comprises a compressor, a condenser, an expansion valve and an evaporator interconnected in series in a closed loop for circulating refrigerant therethrough, the evaporator positioned to receive the flow of air therethrough to be cooled and dehumidified. It includes a first conduit transmitting a flow of liquid refrigerant through the expansion valve to the evaporator to vaporize the liquid refrigerant and to effect cooling for refrigeration of the flow of air; and a second conduit coupling an outlet of the evaporator to an inlet of the compressor to transmit refrigerant vapor to the compressor to be compressed; a third conduit coupling an outlet of the compressor to inlet of the condenser to convey compressed vapor refrigerant from the compressor into the condenser to be condensed into liquid refrigerant at a first pressure and first temperature. A centrifugal pump is coupled to the outlet of the condenser for boosting a pressure of the condensed liquid refrigerant by an incremental pressure to a second pressure. A reheater is positioned adjacent the evaporator and coupled to an outlet of the centrifugal pump, for receiving liquid refrigerant from the centrifugal pump to subcool the liquid refrigerant to a second temperature and to effect a partial reheating of the flow of air cooled by the evaporator thereby decreasing the relative humidity of the flow of the air.

Another aspect of this invention is a method for improving operation of an air conditioning system for cooling and decreasing relative humidity of a flow of air which includes a compressor, a condenser, an expansion valve, and an evaporator connected in series by conduit for circulating refrigerant in a closed loop therethrough, the evaporator positioned to receive a flow of air. The method comprises transmitting liquid refrigerant through the expansion valve into the evaporator; vaporizing a portion of the liquid refrigerant to effect cooling of the flow of air; transmitting vaporized refrigerant from the outlet of the evaporator to the inlet of the compressor; compressing the vaporized refrigerant to produce vapor refrigerant; transmitting the vapor refrigerant from an outlet of the compressor to an inlet of the condenser at a first temperature and first pressure; condensing the vapor refrigerant to discharge liquid refrigerant at a second temperature less than the first temperature; boosting the first pressure of the liquid refrigerant by an incremental pressure to a second pressure; transmitting the liquid refrigerant at the second pressure to an inlet of a reheater, the reheater positioned adjacent the evaporator to receive the cooled flow of air from the evaporator; and subcooling the liquid refrigerant to a third temperature less than the second temperature to improve refrigerant mass flow into the evaporator and to effect a partial reheating of the flow of air cooled by the evaporator, thereby decreasing the relative humidity of the flow of the air.

The foregoing and other objects, features and advantages of the invention will become more readily apparent from the following detailed description of a preferred embodiment of the invention which proceeds with reference to the accompanying drawings.

DETAILED DESCRIPTION

To understand how we can improve the refrigeration cycle we must first analyze the components of a conventional air-conditioning system and understand where the inefficiencies exist.

Figure 1:
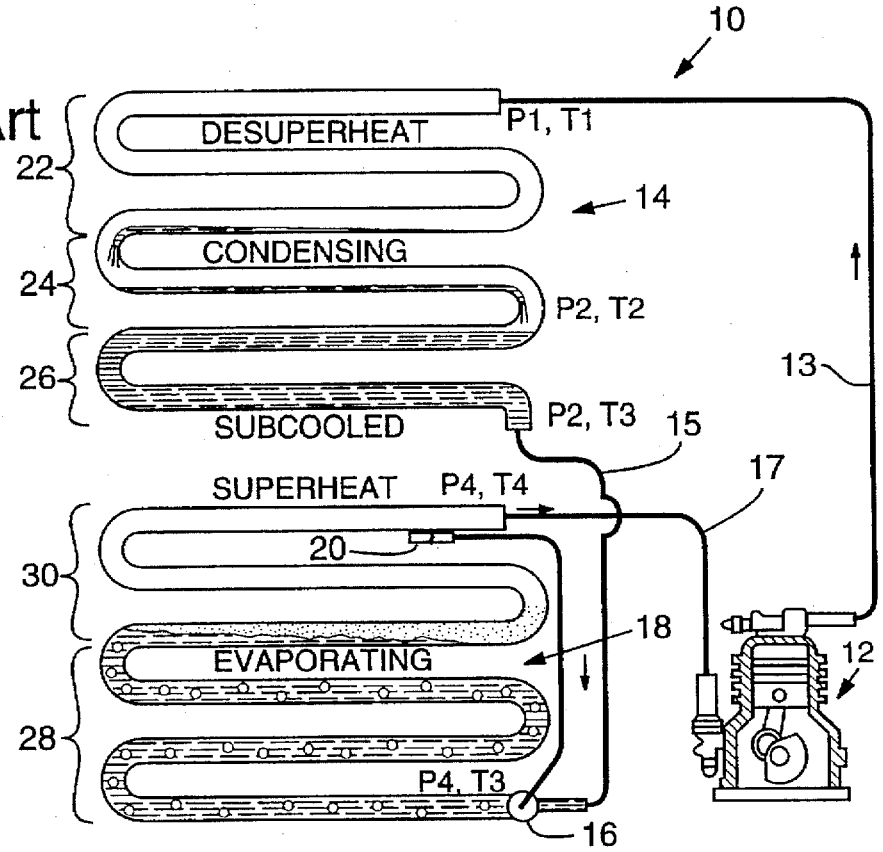
FIG. 1 Prior Art
FIG. 1 is a schematic diagram of a conventional air-conditioning system, with the condenser and evaporator shown in cross section and shaded to indicate regions occupied by liquid refrigerant during condensation and evaporation.

FIG. 1 depicts the conventional air conditioning circuit 10. The circuit of FIG. 1 consists of the following elements: a compressor 12, condenser 14, expansion valve 16, and evaporator 18 with temperature sensor 20 coupled controllably to the expansion valve, connected in series by conduits 13, 15, 17 to form a closed loop system. Shading indicates that the refrigerant within the condenser passes through three separate states as it is converted back to a liquid form: superheated vapor 22, condensing vapor 24 and subcooled liquid 26. Similarly, shading in the evaporator indicates that the refrigerant contained therein is in two states: vaporizing refrigerant 28 and superheated vapor 30. Pressures and temperatures are indicated at various points in the refrigeration cycle by the variables P1, T1, P2, T2, etc.

In the evaporator, only the refrigerant changing from a liquid state 28 (P4, T3) to a vapor state 30 (P4, T4, assuming $\Delta P$ small) provides refrigerating effect. The more liquid refrigerant (state 28) in the evaporator, the higher its cooling capacity and efficiency. The ratio of liquid to vapor refrigerant can vary. The determining factors are the performance of the expansion valve, the proportion of "flash gas" entering the evaporator through the valve, and the temperature T3 and pressure P4 of the entering liquid refrigerant.

As can be seen in FIG. 1, only superheated vapor (state 30) enters the compressor 12. The term "superheat" refers to the amount of heat in excess of the latent heat of the vaporized refrigerant, that is, heat which increases its volume and/or pressure. High superheat at the compressor inlet can add considerably to the work that must be performed by other components in the system. Ideally, the vapor entering the compressor would be at saturation, containing no superheat and no liquid refrigerant. In most systems using a reciprocating compressor 12 is not practical. We can, however, make significant improvements.

The discharge heat of the vapor exiting from the compressor includes the superheat of the vapor entering the compressor plus the heat of compression, friction and the motor added by the compressor. At the entrance of the condenser, all of the refrigerant consists of superheated vapors at pressure P1 and temperature T1. The portion of the condenser needed to desuperheat the refrigerant (state 22) is directly related to the temperature T1 of the entering superheat vapors. Only after the superheat is removed can the vapors start to condense (state 24).

The superheated vapors 22 are subject to the Gas Laws of Boyle and Charles. At a higher temperature T1, they will tend to either expand (consuming more condenser area) or increase the pressures P1 and P2 in the condenser, or a combination of both. The rejection of heat at this point is vapor-to-vapor, the least effective means of heat transfer.

As the vapors enter the condensing potion of the condenser they are at saturation (state 24) and at a pressure P2 and temperature T2 which are less than P1 and T1, respectively. At this stage, further removal of latent heat will convert the vapors into the liquid state 26. The pressure P2 will not further change during this stage of the process.

As the refrigerant starts to condense, the condensation will take place along the walls of the condenser. At this point, heat transfer is from liquid-to-vapor, and produces a more efficient rejection of unwanted heat.

The condensing pressures are influenced by the condensing area (total condenser area minus the used for desuperheating and the area used for subcooling). The effect of superheat can be observed as both a reduction in condensing area (state 24) and an increase in the overall pressure (both P1 and P2).

In an effort to suppress the formation of flash gas entering the expansion valve, many manufacturers use part of the condenser to further cool or subcool the liquid refrigerant to a lower temperature T3 (state 26). If we consider only the subcooling of the liquid without regard to decreased condensing surface, then we can expect a gain of ½% refrigeration capacity per degree (F.) of subcooling. If we consider the reduction in condensing surface, however, then there is a net loss of capacity and efficiency due to increased condensing temperature T2 and higher head pressure P1.

Analysis of the refrigeration cycle shows several factors that can be improved. Combining these factors, as described with reference to FIG. 4, can dramatically improve the overall capacity and efficiency of performance.

Figure 2:
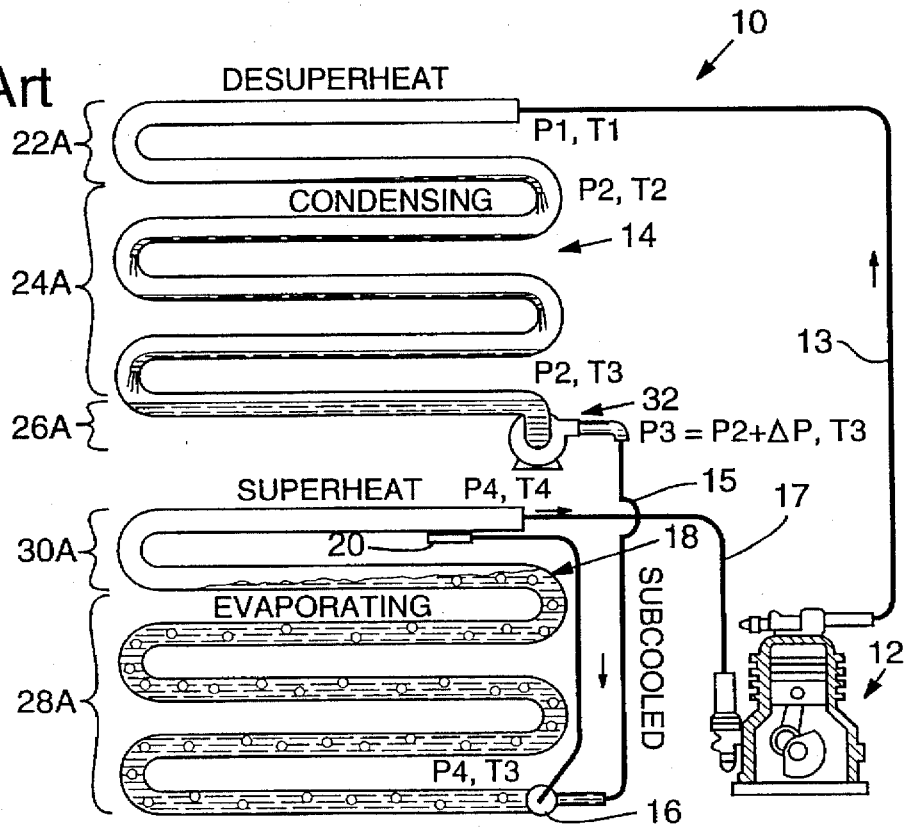
FIG. 2 Prior Art
FIG. 2 is a view similar to FIG. 1 showing the system as modified 16 include a liquid pump in accordance with the teachings of my prior patent.

FIG. 2 illustrates, in an air-conditioning system, the effects of liquid pumping as taught in my prior U.S. Pat. No. 4,599,873, incorporated herein by reference. The system is largely the same as that of FIG. 1, so like reference numerals are used on like parts. The various states are indicated by like reference numerals followed by the letter "A." Temperatures and pressures are also indicated in like manner with the understanding that the quantities symbolized by the variables differ substantially in each system.

The principal structural difference is that a liquid refrigerant centrifugal pump 32 is installed between file outlet of the condenser 14 (on systems that do not have a receiver) and the expansion valve 16. The pump 32 increases the pressure P2 of the liquid refrigerant flowing from the condenser outlet by a ΔP of 8 to 15 p.s.i. to an incrementally increased pressure P3. This is referred to as the liquid pressure amplification process. The pressure added to the liquid refrigerant will transfer the refrigerant to the subcooled region of the enthalpy (i.e., P3>P2, T3 same and will not allow the refrigerant to flash prematurely, regardless of head pressure. By eliminating the need to maintain the standard head pressure, minimum head pressure P1 can be lowered to 30 p.s.i. above evaporator pressure P4 in air-conditioning and refrigeration systems. Condensing temperature T1 can float rather than being set to a fixed minimum temperature in a conventional system, e.g., 105° F. in R-22 air-conditioning systems. If ambient temperature is 65° F., using a pump 32 in an R-22 air-conditioning system lowers condensing temperature T1 to about 86° F. at full load. Additionally, head pressure P1 is lowered, as next explained.

For the evaporator 18 to operate at peak efficiency it must operate with as high a liquid-to-vapor ratio as possible. To accomplish this, the expansion valve 16 must allow refrigerant to enter the evaporator at the same late that it evaporates. Overfeeding or underfeeding of the expansion valve will dramatically affect the efficiency of the evaporator. Using pump 32 assures an adequate feed of liquid refrigerant to valve 16 so that the exhaust refrigerant at the intake of compressor 12 is at a temperature T4 and pressure P4 closer to saturation.

Figure 3:
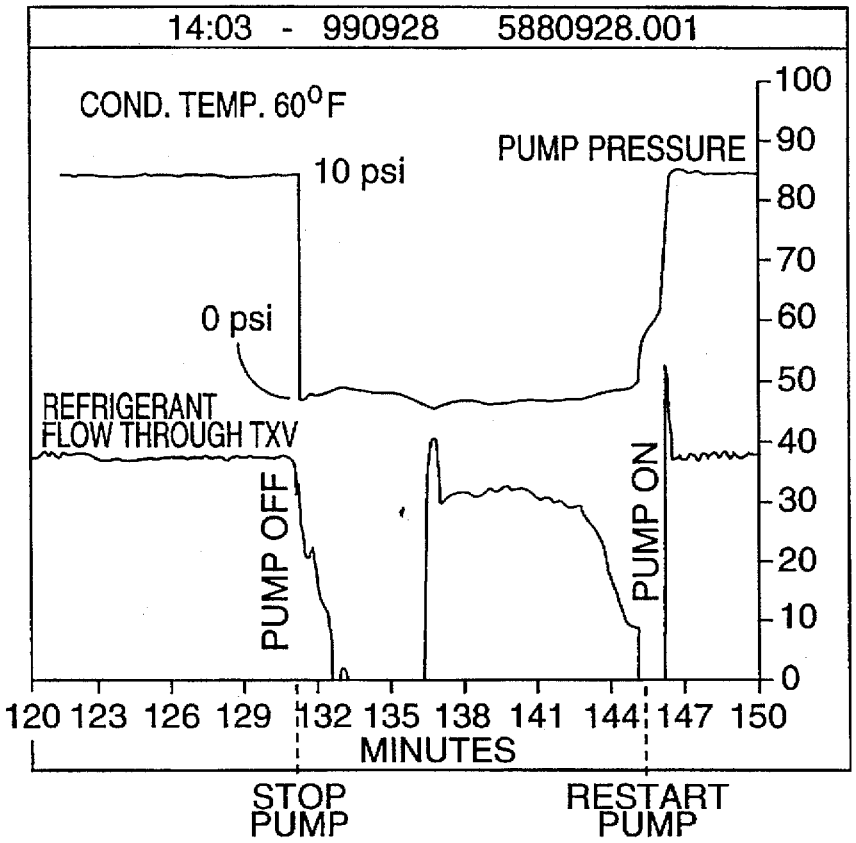
FIG. 3 is a graph of certain parameters of operation of the system of FIG. 2 with the liquid pump ON and OFF.

FIG. 3 graphs the flow rate of refrigerant through the expansion valve 16 in laboratory tests with and without the liquid pump 32 running. The upper trace indicates incremental pressure added by pump 32 and the lower trace graphs the low rate of refrigerant through the expansion valve. The test begins with the system running in steady state with centrifugal pump 32 ON. At 131 min. the pump was turned OFF. The flow rate of refrigerant entering the evaporator 18 through the expansion valve 16 (TXV) shows a decided decrease in flow compared to the flow when the pump is running. An increase in head pressure only partially restores refrigerant flows. The reduced flow of refrigerant to the evaporator has several detrimental effects, as shown in FIG. 1. Note the reduced effective evaporator area 28 as compared to area 28A in FIG. 2.

At 150 min., the liquid pump 32 is turned ON. With the pump 32 again running, the flow rate is consistently higher, with an even modulation of the expansion valve, because of the absence of flash gas. It can be seen that running the pump increases the amount of refrigerant in the evaporator yet the superheat setting of the valve controls file modulation of the expansion valve at a consistent flow rate. The net result is a greater utilization of the evaporator 18 as shown in FIG. 2 (note state 28A).

The efficiency of the compressor 12 is related to a number of factors, most of which can be improved when the liquid pumping system is applied. The efficiencies can be improved by reducing the temperature in the cylinders of the compressor, by increasing the pressure P4 of the entering vapor, and by reducing the pressure P1 of the exiting vapor. With the vapor entering the compressor at a higher pressure, the compressor capacity will increase. With cooler gas (T4) entering the cylinders, the heat retained in the compressor walls will be less, thereby reducing the expansion, due to heat absorption, of the entering vapor.

With these improvements on the suction side of the compressor, the condensing temperature T1 can float with the ambient to a lower condensing temperature in the system of FIG. 2. This reduces the lift, or work, of the compressor by reducing the difference between P4 and P1. The increased capacity or power reduction, due to the lower condensing temperatures, will be approximately 1.3% for each degree (F.) that the condensing temperature is lowered. As explained earlier, the liquid pump's added pressure AP maintains all liquid leaving the pump 32 in the subcooled region of the enthalpy diagram. For this reason, it is no longer necessary to flood the bottom part of the condenser (See 26 in FIG. 1) to subcool the refrigerant. This portion of the condenser now be used to condense vapor (Compare state 24A of FIG. 2 with state 24 in FIG. 1). This increased condensing surface can further lower the condensing temperature T2 and pressure P2. The temperature T3 of the refrigerant leaving the condenser will be approximately the same as if subcooled, but with little or no subcooling (state 26A).

With the application of the pump 32, the evaporator discharge or superheat temperature T4 and compressor intake pressure P4 have been reduced considerably from the corresponding parameters in the system of FIG. 1.

The best results are obtained when such a system is operated with the condenser at moderate ambient temperatures, usually under 80° F. As ambient temperatures rise above the minimum condensing temperature, the advantages gradually decrease. At a typical ambient temperature of around 75° F., a typical improvement in efficiency of the system of FIG. 2 over that of FIG. 1 is 7%–10%, declining to negligible at 100° F. ambient temperature.

I have discovered, however, that an additional 6% to 8% savings can be achieved under typical ambient conditions. Moreover, we can obtain very substantial improvements of efficiency and effectiveness at ambient temperatures over 100° F.

Figure 4:
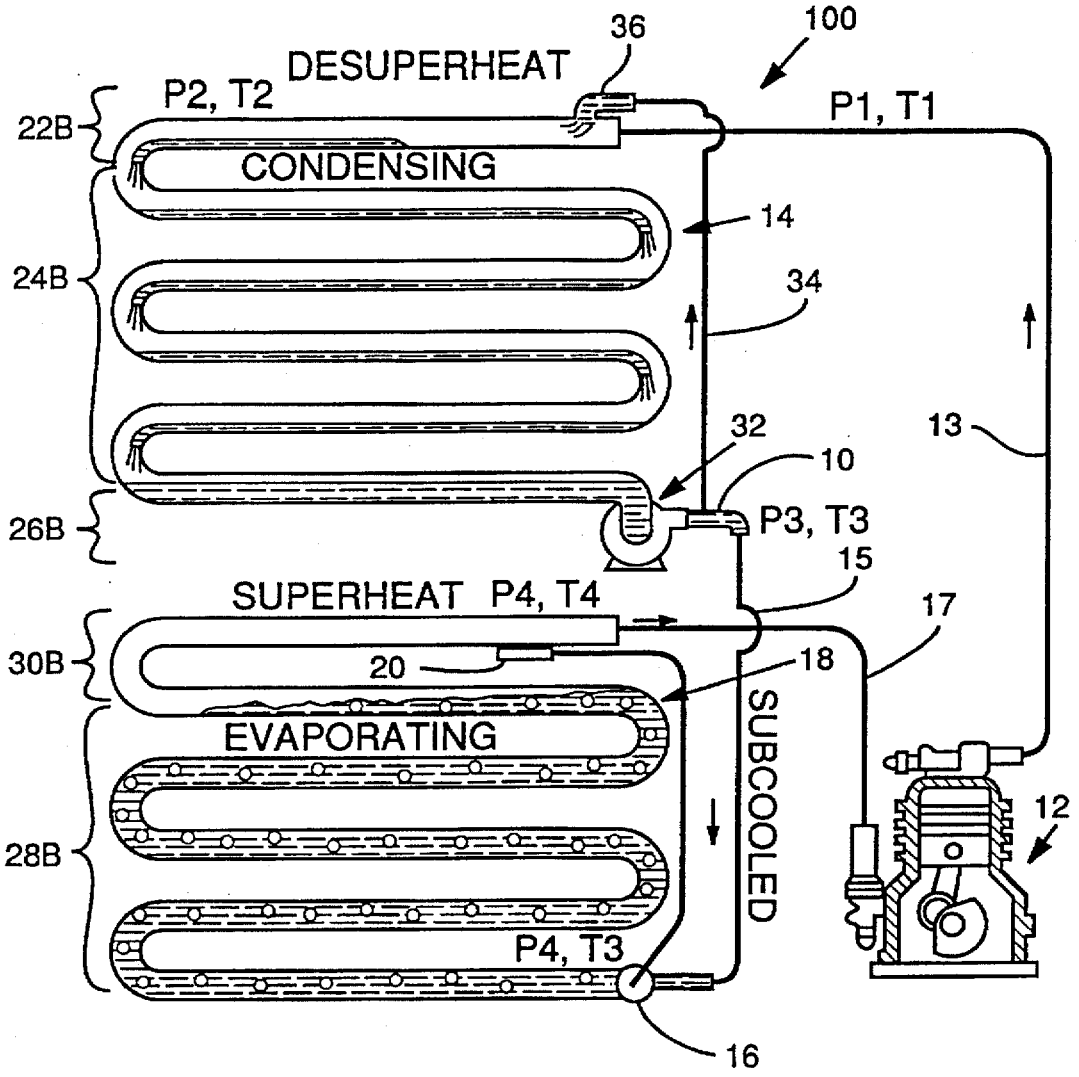
FIG. 4 is a view similar to that of FIG. 2 showing the system as further modified for superheat suppression in accordance with the present invention.

FIG. 4 shows an air-conditioning system 100 as taught in my U.S. Pat. No. 5,150,580. The general configuration of the system resembles that of system 10A in FIG. 2. In accordance with the invention, however, a conduit or line 34 is connected at one end to the outlet of pump 32 and at the opposite end to an injection coupling 36 at the entrance to the condenser. This circuitry enables a portion of the condensed liquid refrigerant to be injected at temperature T3 from the pump outlet into the entrance of condenser. As this liquid refrigerant enters the desuperheating portion of the condenser, it will immediately reduce the temperature of, and thereby suppress, the superheated vapors entering the condenser at pressure P1 and temperature T1.

The amount of refrigerant injected at coupling 36 should be sufficient to dissipate the superheated vapors and preferably reduce the incoming temperature T1 to a temperature close (within 10° F.–15° F.) to the saturation temperature T2 of the refrigerant. In a 10 ton, 120,000 BTU air-conditioning system, line 15 has an inside diameter of ½ inch and line 34 has an inside diameter of ⅛ inch, for a cross-sectional ratio of line 34 to line 15 of 1:16 or about 6%. Due to flow rate differences and variations (e.g., due to modulation off valve 16 by sensor 20) the flow ratio is less than about 5%, probably 2%–3%, in a typical application.

Suppression of superheated vapor will have four effects:

(1) By reducing the superheat temperature T1, the pressure P1 and volume of the superheat vapors will both be reduced.

(2) The vapor will be very close to or at saturation point (T2, P2), (3) Condensing will occur closer to the inlet of the condenser.

(4) Heat transfer will be higher because of liquid-to-vapor heat transfer over a greater area of the condenser (compare state 24B with state 24A).

The injection of liquid refrigerant into the condenser 14 is accomplished using the same pump 32 that is installed for the liquid pressure amplification process. By reducing the work required to desuperheat the refrigerant vapor, the pump can perform a substantial portion of the work required to recirculate the liquid through the condenser. Although some gain can be seen at low ambient temperature, with this process of superheat suppression, the best gains will be realized at higher ambient temperature. This is just the opposite of the benefits noted with liquid refrigerant amplification alone. For example, at over 100° F., the system of FIG. 2 gives little if any increase in efficiency and capacity over the system of FIG. 1. Tests hard shown that the system of FIG. 4, on the other hand, will provide efficiency increases of 10%–12% at 100° F. and as much as 20% at 113° F., and add capacity to allow air conditioning to be run effectively in the desert.

Figure 5:
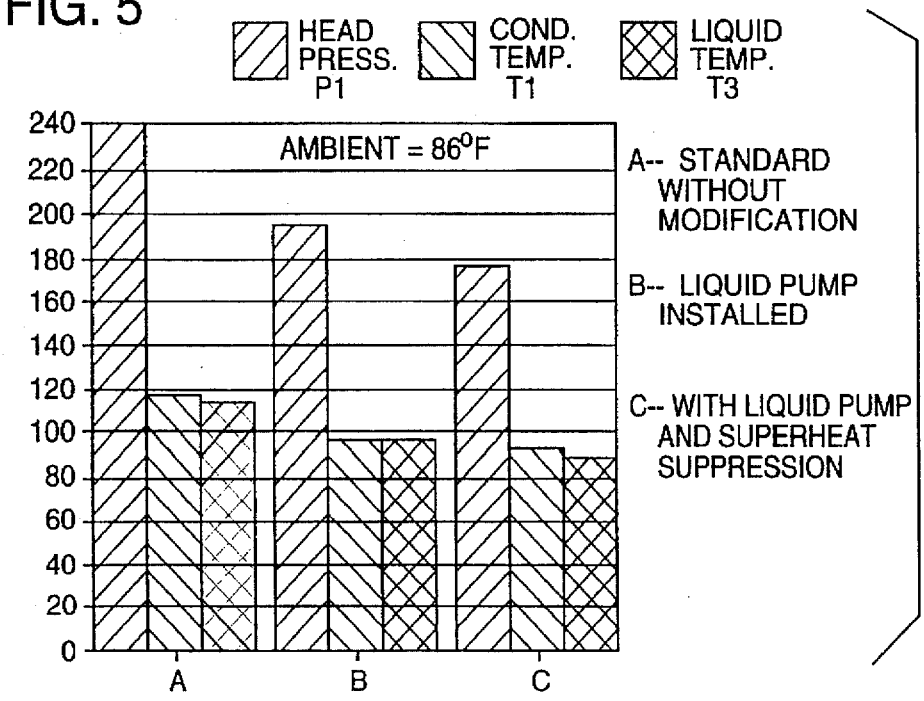
FIG. 5 is a chart of test results comparing three parameters for each of the systems of FIGS. 1, 2 and 4 operating under like ambient conditions.

FIG. 5 is a graph of actual results achieved in a test of a 60 ton Trane air-conditioning system comparing operation of system 100 of FIG. 4 with operation of systems 10 and 10A of respective FIGS. 1 and 2. All readings were taken at 86° F. ambient temperature. The readings are: A. standard system without modification (FIG. 1), B. same system adding the pump 32 only (FIG. 2), and C. the same system modified in accordance with the present invention to include both pump 32 and superheat suppression circuitry 34, 36 (FIG. 4). For each parameter—head pressure P1 (p.s.i.), condensing temperature T1 (°F.) and liquid temperature T3 (°F.) entering the evaporator—configuration C, the present invention, demonstrated lower readings. Such performance characteristics enable a system 100 according to the present invention to provide a greater cooling capacity as well as greater efficiency. These advantages continue to higher ambient temperatures, including temperatures at which configurations A and B would no longer be effective.

I have discovered, however, that by using the present invention, next described, I can remove 50% more water under typical ambient conditions while achieving a 12% reduction in energy. This savings is accomplished by using a centrifugal pump and reheater to pressurize and subcool the liquid discharged from the condenser. The pump partially and indirectly subcools the liquid refrigerant by increasing its pressure. The reheater coil further and directly subcools the liquid refrigerant by reducing its temperature. The increased pressure produced by the pump keeps the refrigerant from flashing as it flows to the reheater and therefore maintains good heat transfer. Without the pump to suppress flash gas, vapor could form in the conduit between the condenser and reheater, causing a pressure drop, which would degrade the mass flow through the expansion valve. Also, the reheater would primarily operate as a recondenser, rather than as a true subcooler.

The reheater is positioned in the flow of cooled air that has passed through the evaporator and coupled to circulate refrigerant input at condensing temperature. The reheater heats the flow of cooled air discharged from the evaporator and thereby increases the air's relative humidity. This process also subcools the liquid refrigerant flowing to the expansion valve and evaporator by removing heat from the refrigerant and thereby reducing its temperature. The evaporator efficiency is thereby increased and its temperature is reduced. This increases the cooling of air by the evaporator and results in up to 50% more moisture being precipitated from the intake air than in conventional air conditioning systems. Furthermore, this system reduces refrigerant flashing which decreases the amount of compressor work necessary to operate the system.

Figure 6:
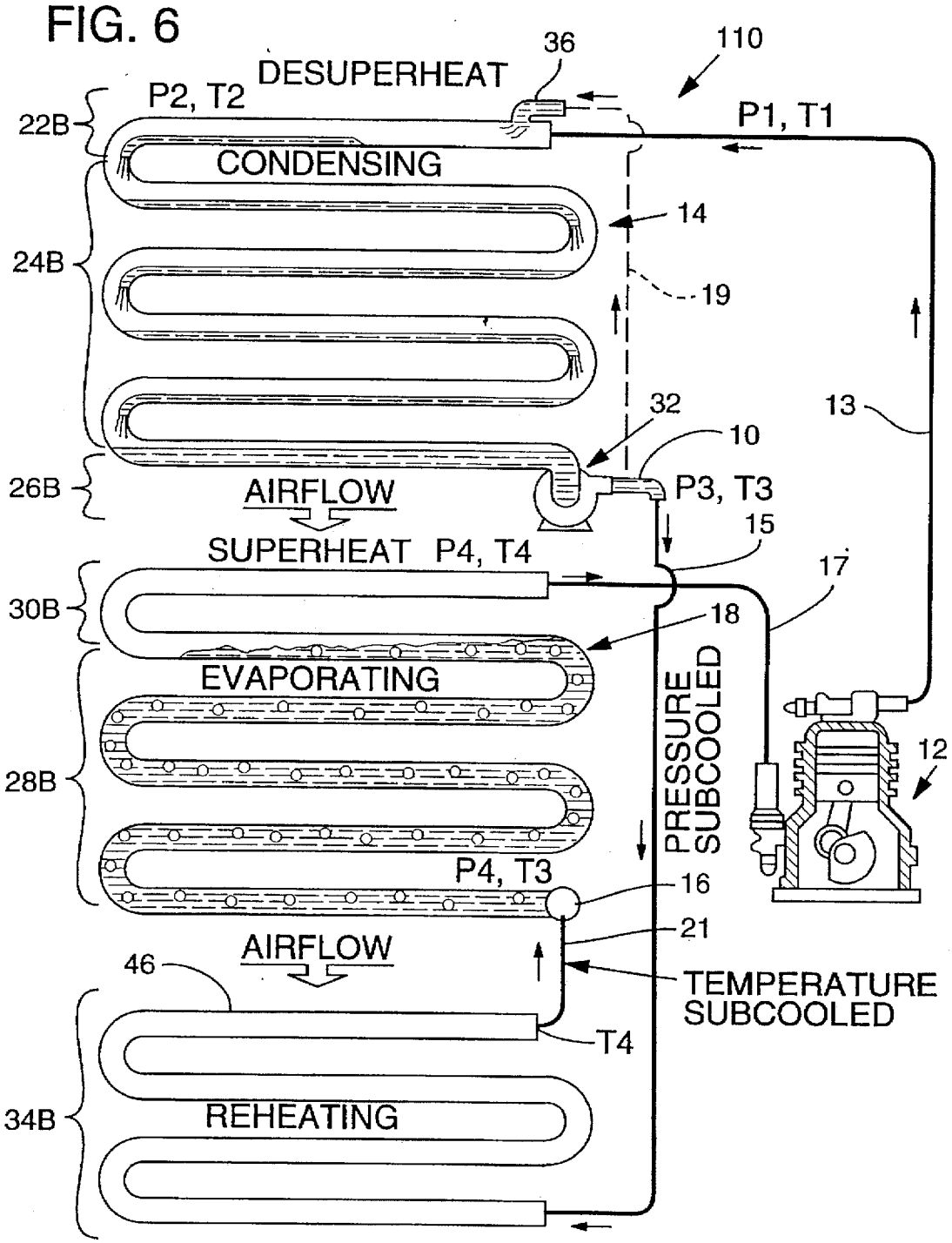
FIG. 6 is a view similar to that of FIG. 4 showing the system as further modified to include a reheater according to the present invention.

FIG. 6 shows an air conditioning system 110 in accordance with the present invention. The general configuration of the system is similar to that of system 100 shown in FIG. 4 except for the addition of reheater 16. Reheater 16 receives the entire amount of condensed liquid refrigerant pumped from the outlet of condenser 14 by pump 32.

Centrifugal pump 32 can range from about 1/25 H.P. to ¾ H.P. and boosts the pressure of the liquid refrigerant approximately 5–30 p.s.i., depending on system size and operating conditions. The centrifugal pump 32 is preferably a sealless pump, more preferably a magnetic drive pump, wherein the pump impeller is semihermetically sealed (either alone or with a drive motor) and driven via a connection to the motor that does not require a sealed shaft.

The condensed liquid refrigerant is transmitted via conduit 15 from the outlet of centrifugal pump 32 to the inlet of reheater 46. Reheater 46 can be any air-cooled heat exchanger. Preferably, it is a tube bundle which has heat exchanger fins upon the tubes. The reheater is positioned in the discharge path of the cooled air that has passed through the evaporator. This air further cools the condensed liquid refrigerant and is heated slightly in the process.

The further cooled liquid refrigerant discharged from the reheater is transmitted via conduit 21 through thermal expansion valve 16 into evaporator 18. Evaporator 18 can be any air-cooled heat exchanger similar to reheater 46. As liquid refrigerant flows into the evaporator on the tube side it vaporizes. As it vaporizes, the refrigerant absorbs heat.

As intake air flows through the evaporator and over the tubes containing vaporizing refrigerant, heat is transferred from the intake air to the refrigerant which cools the air. Preferably, evaporator 18 cools the air to approximately 60° F. The cooled air then passes though the reheater; is partially reheated by the condensed refrigerant; and subcools the condensed refrigerant to a temperature well below its condensing temperature.

In an alternative embodiment, a portion of the liquid refrigerant can be recycled back to the condenser inlet as previously described. Optional branch conduit 19 carries a portion of the recycled liquid refrigerant from the outlet of pump 32 to injector 36 and desuperheating is accomplished as described above.

Figure 7:
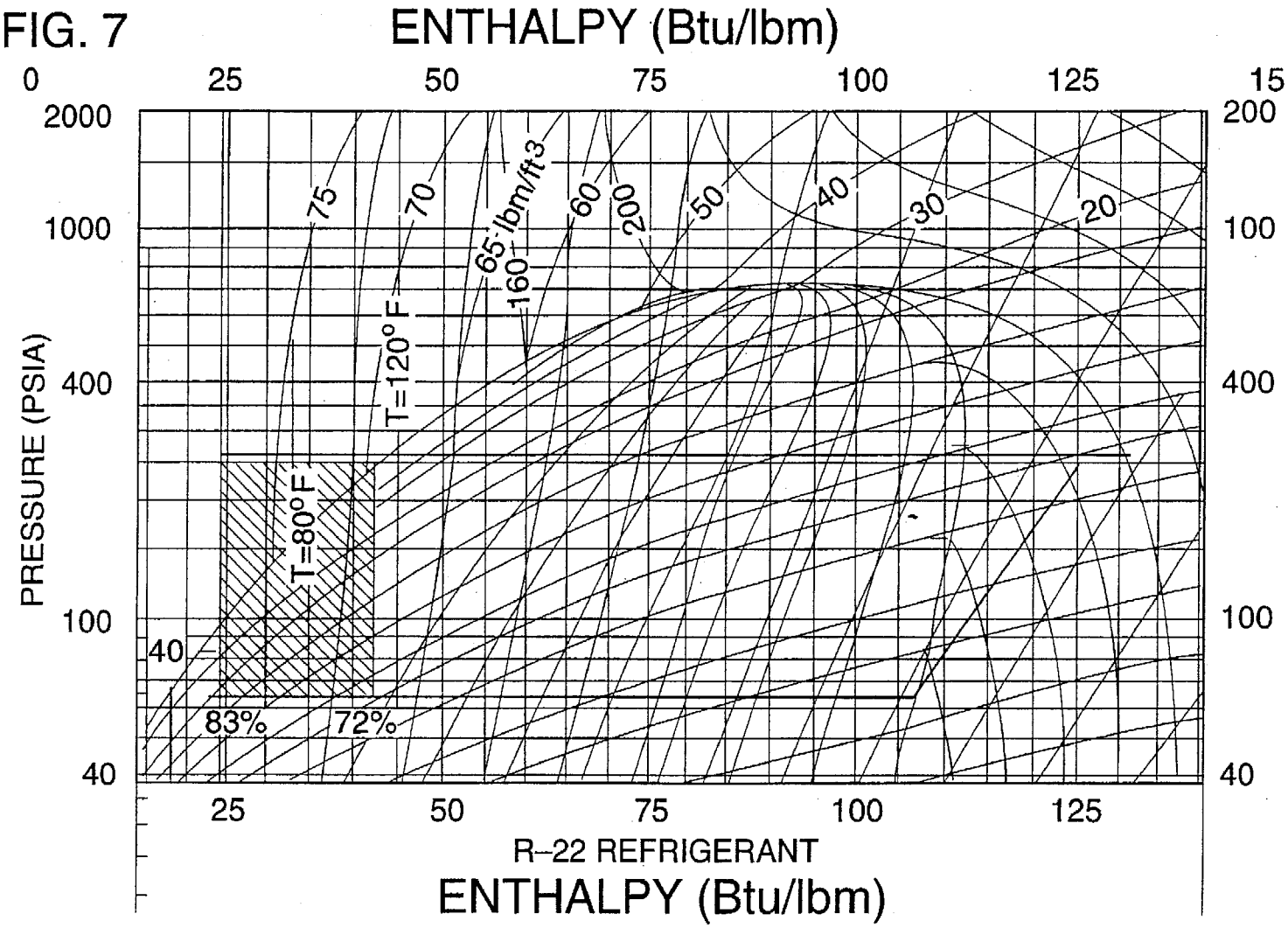
FIG. 7 is an enthalpy chart for the system of FIG. 6 which graphically illustrates the energy savings of the present invention.

FIG. 7 is an enthalpy chart for the system of FIG. 6 using R-22 refrigerant. It shows that the percent quality (ratio of liquid to total refrigerant) of the refrigerant in the evaporator is at about 72% in a system operation without the subcooling provided by the reheater. In other words, 28% of the refrigerant had to vaporize upon passing through the expansion valve to reach the cooling temperature and would later have to be recompressed. But with the reheater in operation, the percent quality of refrigerant increased to approximately 83% (i.e. 17% vapor). This process removes about 17 BTU/lbm, which reduces the mass flow of refrigerant needed to produce the same net refrigeration effect. This reduction equates to a decrease in compressor work of about 10%.

Typically, in an R-22 system, the liquid refrigerant enters the reheater 46 at its condensing temperature of about 105° F. Preferably, the reheater subcools the refrigerant to within about 8° F. of the temperature of the air discharged from the evaporator 18. In general, the invention obtains approximately a ½ gain in capacity for each degree °F. of subcooling. For example, if the air leaving the evaporator 18 was 60° F., the liquid refrigerant could be subcooled to 68° F. and the air reheated to about 65° F. Assuming a 105° F. normal temperature and 37° F. of subcooling, there would be a theoretical 18.5% increase in capacity.

In actual tests of an approximately ¾ ton R-22 air conditioner exhausting to an ambient air temperature of about 75° F. and using a single-pass tube reheater of the same approximate face area as the evaporator, net energy reduction of 12% was achieved by using the reheater. At the same time, the system yielded a 50% increase in the amount of water being removed from the space being cooled. Condensing temperature and pressure were reduced from about 102° F. and 190.3 psig without reheating to about 93° F. and 175.8 psig with reheating. Evaporator air temperature was 56° F. dry bulb and 53.6° F. wet bulb without reheating and 53.6° F. dry bulb and 51.6° F. wet bulb with reheating. The subcooling effected by reheating was 29.03° F. The air discharged from the reheat coil when the reheating coil was disabled (refrigerant routed directly from the pump outlet to the expansion valve) measured 1-hour average temperatures, of 56.8° F. dry bulb and 53.7° F. wet bulb. With reheating (refrigerant routed through reheater) 1-hour average measured temperatures were 56.3° F. dry bulb and 52.8° F. wet bulb. The differences in these measured temperatures are 3.15° F. without reheat and 3.45° F. with reheat, reflecting a decrease of relative humidity of the air leaving the reheated coil. This difference would be more pronounced at higher ambient temperatures.

Figure 8:
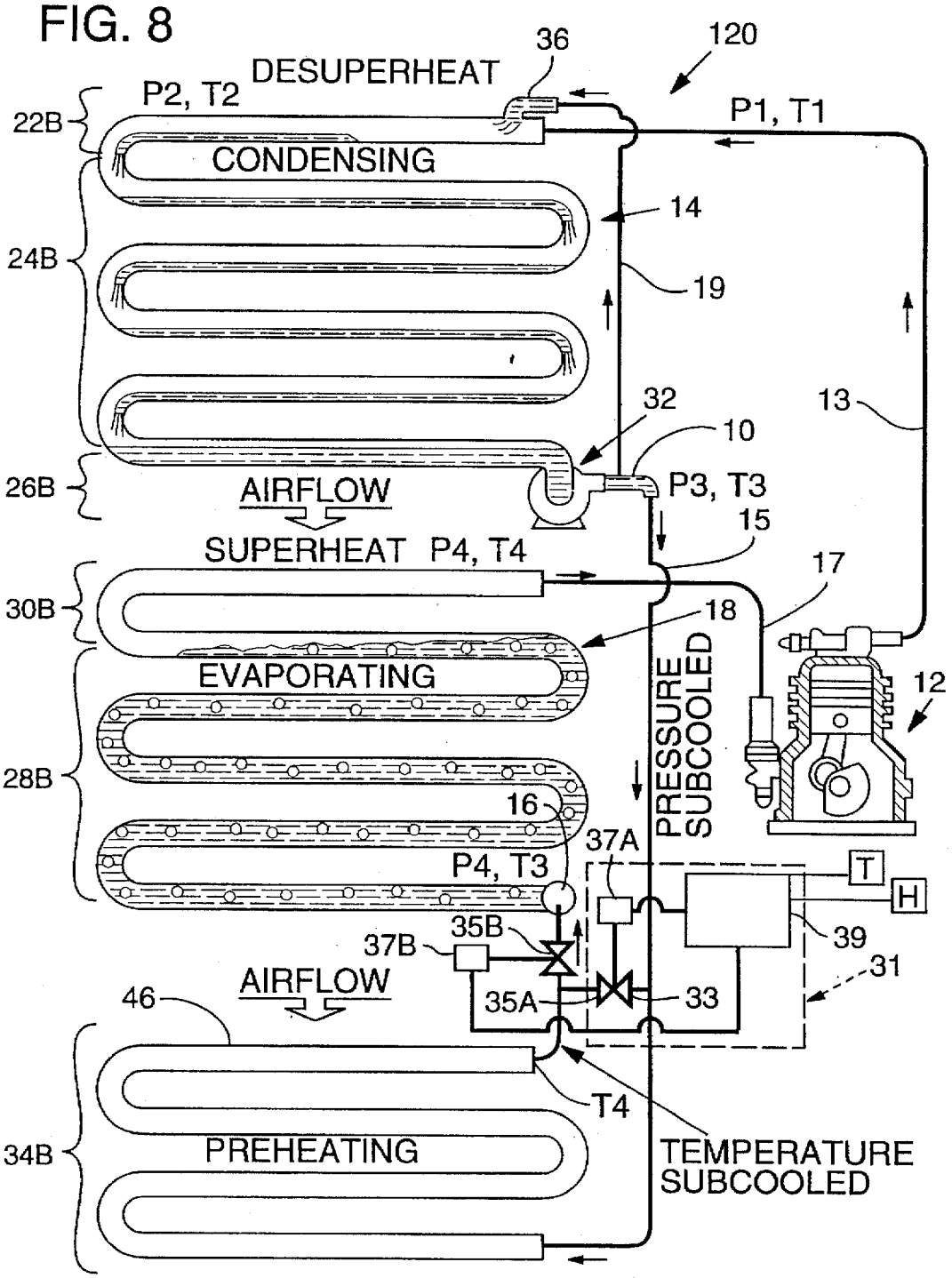
FIG. 8 is a view similar to that of FIG. 6 showing the system as further modified to include a climate control system according to the present invention.

FIG. 8 shows an air conditioning system 120 in accordance with an alternative embodiment of the invention. The general configuration of the system is similar to that of system 110 shown in FIG. 6 except for the addition of a climate control system 31. Control system 31 comprises a reheater bypass conduit 33; control valves 35A, solenoid 37A and an analog or digital controller 39. Pump down valve 35B and solenoid 37B allow the operator to pump down evaporator 18. Control system 31 allows the operator of the system to control the climate by controlling the latent and sensible heat present within the flow of air. In normal operation, valve 35A is normally closed while valve 35B is normally open. Responsive to the controller 39, however, the position of the valves can be switched to control ambient climatic conditions.

Specifically, the amount of latent heat in the flow of air can be controlled by monitoring and adjusting the amount of humidity present in the flow of air. For example, controller 39 can be programmed to electronically or pneumatically actuate solenoid 37A when the flow of air reaches a certain desired humidity, thereby opening valve 35A in bypass conduit 33. This action allows the pressure-subcooled liquid to bypass the reheater 46 and to flow directly to the inlet of the evaporator 18. Controller 39 can also be programmed to actuate solenoid 37B, thereby closing valve 35B to facilitate pump down of the evaporator. Preferably, a humidistat H is electrically coupled to the controller 39 and is positioned to detect the humidity of the return air or positioned at any other suitable location to monitor the humidity of the flow of air. Humidity signals are then transmitted to the controller 39 which is programmed to maintain the humidity of the flow of air within a desired range.

Similarly, the amount of sensible heat within the flow of air can be controlled by monitoring and adjusting the temperature of the flow of air. Preferably, a thermostat T is electrically coupled to the controller 39 and is positioned to detect the temperature of the return air or positioned at any other suitable location to monitor the temperature of the flow of air. Temperature signals are then transmitted to the controller 39 which is programmed to maintain the temperature of the flow of air within a desired range. Additionally, workers in the field will appreciate that any combination of temperature and humidity ranges can be maintained using the control system hereinabove described.

Having described and illustrated the principles of the invention in a preferred embodiment thereof and variation, it should be apparent that the invention can be modified in arrangement and detail without departing from such principles. For example, a multiple pass coil can be used as the reheater. I claim all modifications and variation coming within the spirit and scope of the following claims.

What is claimed is:

1. A method for improving operation of an air conditioning system for cooling and decreasing relative humidity of a flow of air which includes a compressor, a condenser, an expansion valve, and an evaporator connected in series by conduit for circulating refrigerant in a closed loop therethrough, the evaporator positioned to receive a flow of air, the method comprising:

transmitting liquid refrigerant through the expansion valve into the evaporator;

vaporizing at least a portion of the liquid refrigerant;

passing a flow of air over a surface of the thereby cooling the flow of air;

transmitting vaporized refrigerant from the outlet of the evaporator to the inlet of the compressor;

compressing the vaporized refrigerant to produce superheated compressed vapor refrigerant;

transmitting the superheated compressed vapor refrigerant from an outlet of the compressor to an inlet of the condenser at a first temperature and first pressure;

condensing the compressed vapor refrigerant from the condenser;

discharging liquid refrigerant from the condenser at a second temperature less than the first temperature;

boosting the first pressure of the liquid refrigerant discharged from the condenser by an incremental pressure to a second pressure;

transmitting a first portion of the liquid refrigerant the second to the condensor to provide desuperheating to the superheated compressed vapor refrigerant;

transmitting a second portion of the liquid refrigerant at said second pressure to an inlet of a reheater, the reheater positioned adjacent the evaporator to receive the cooled flow of air from the evaporator;

subcooling the liquid refrigerant in the reheater to a third temperature less than said second temperature and partially reheating the cooled flow of air received by the reheater from the evaporator thereby decreasing the relative humidity of the cooled flow of the air; and controlling the flow of liquid refrigerant through the reheater so as to control the climate of the flow of air.

2. A method according to claim 1 wherein the boosted liquid refrigerant is subcooled to less than 20° F. above the temperature of the cooled flow of air received from the evaporator.

3. A method according to claim 1 wherein the boosted liquid refrigerant is subcooled at least 10° F. below the first temperature.

4. A method according to claim 1 in which the condensed liquid refrigerant is boosted an increment of pressure sufficient to suppress flash gas in the refrigerant flowing to the reheater.

5. An air conditioning system for cooling and decreasing relative humidity of a flow of air, the system comprising:

a compressor, a condenser, an expansion valve and an evaporator interconnected in series in a closed loop for circulating refrigerant therethrough, the evaporator positioned in series to receive the flow of air therethrough to be cooled and dehumidified;

a first conduit transmitting a flow of liquid refrigerant through the expansion valve to the evaporator to vaporize at least a portion of the cooling refrigerant and to effect cooling for refrigeration of the flow of air;

a second conduit coupling an outlet of the evaporator to an inlet of the compressor to transmit refrigerant vapor to the compressor to be compressed;

a third conduit coupling an outlet of the compressor to an inlet of the condenser to convey compressed vapor refrigerant from the compressor into the condenser to be condensed into liquid refrigerant at a first pressure and first temperature;

a pump, for boosting a pressure of the condensed liquid refrigerant by an incremental pressure to a second pressure;

a fourth conduit coupling the outlet of the condenser to the inlet of the pump for transmitting liquid refrigerant discharged from the condenser to the pump;

a fifth conduit an outlet of the pump to the condenser for transmitting liquid refrigerant to the condenser for desuperheating the superheated compressed vapor refrigerant in the condenser; and a reheater positioned adjacent the evaporator receiving cooled air therefrom and coupled to an outlet of the pump including surfaces for receiving liquid refrigerant from the pump to subcool the liquid refrigerant to a second temperature less than the first temperature and to effect a partial reheating of the flow of air cooled by the evaporator thereby decreasing the relative humidity of the flow of the air.

6. A system according to claim 5 in which the magnetic drive pump includes:

motor means for driving the pump; and a magnetic pump drive connecting the motor means to the pump to drive the pump.

7. An air conditioning system for cooling and decreasing relative humidity of a flow of air, the system comprising:

a compressor, a condenser, an expansion valve and an. evaporator interconnected in series in a closed loop for circulating refrigerant therethrough, the evaporator positioned in series to receive the flow of air therethrough to be cooled and dehumidified;

a first conduit transmitting a flow of liquid refrigerant through the expansion valve to the evaporator to vaporize least a portion of the liquid refrigerant and to effect cooling for refrigeration of the flow of air;

a second conduit coupling an outlet of the evaporator to an inlet of the compressor to transmit refrigerant vapor to the compressor to be compressed;

a third conduit coupling an outlet of the compressor to an inlet of the condenser to convey superheated compressed vapor refrigerant from the compressor into the condenser to be condensed into liquid refrigerant at a first pressure and first temperature;

a pump;

at fourth conduit coupling the outlet of the condenser to the inlet of the pump for transmitting liquid refrigerant discharged from the condenser to the pump;

a fifth conduit coupling an outlet of the pump to the condenser for transmitting liquid refrigerant to the condenser for desuperheating the superheated compressed vapor refrigerant in the condenser;

a reheater positioned adjacent the evaporator receiving cooled air therefrom and coupled to an outlet of the condenser including surfaces for contacting liquid refrigerant from the condenser to subcool the liquid refrigerant to a second temperature less than the first temperature and to effect a partial reheating of the flow of air cooled by the evaporator thereby decreasing the relative humidity of the flow of the air; and means, coupled between the inlet of the evaporator and the outlet of the condenser, for controlling the climate within the flow of air.

8. A system according to claim 7 wherein the climate control means comprises:

a reheater bypass conduit coupled between an inlet of the evaporator and the outlet of the condenser;

a bypass control valve positioned on the reheater bypass conduit for controlling the flow of liquid between the outlet of the condenser and the inlet of the evaporator; and means for actuating the control valve responsive to a climate control sensor.

9. A system according to claim 8 further comprising:

a pump-down control valve positioned on a conduit wherein the conduit is coupled between an outlet of the preheater and the inlet of the evaporator; and a solenoid, electrically coupled to the controller and capable of being actuated by the controller, coupled to the bypass control valve and being capable of actuating the valve wherein the controller is programmed to actuate the backflow control valve solenoid in response to humidity and temperature signals.

10. A method for improving operation of an air conditioning system for cooling and decreasing relative humidity of a flow of air which includes a compressor, a condenser, an expansion valve, and an evaporator connected in series by conduit for circulating refrigerant in a closed loop therethrough, the evaporator positioned to receive a flow of air, the method comprising:

transmitting liquid refrigerant through the expansion valve into the evaporator;

vaporizing at least a portion of the liquid refrigerant to effect cooling of the flow of air;

transmitting vaporized refrigerant from the outlet of the evaporator to the inlet of the compressor;

compressing the vaporized refrigerant to produce superheated compressed vapor refrigerant;

transmitting the superheated compressed vapor refrigerant from an outlet of the compressor to an inlet of the condenser at a first temperature and first pressure;

condensing the compressed vapor refrigerant;

discharging liquid refrigerant at a second temperature less than the first temperature;

pressurizing and transmitting a first portion of the discharged liquid refrigerant to the inlet of the condenser to provide desuperheating to the superheated compressed vapor refrigerant;

transmitting a second portion of the liquid refrigerant from the condenser to an inlet of a reheater, the reheater positioned adjacent the evaporator to receive the cooled flow of air from the evaporator;

subcooling the liquid refrigerant in the reheater to a third temperature less than said second temperature and partially reheating the cooled flow of air received by the reheater from the evaporator thereby decreasing the relative humidity of the cooled flow of the air; and controlling the flow of liquid refrigerant through the reheater so as to control the climate of the flow of air.

* * * * *